US009022730B2

(12) United States Patent
Vysohlid et al.

(10) Patent No.: US 9,022,730 B2
(45) Date of Patent: May 5, 2015

(54) SUPERSONIC COMPRESSOR STARTUP SUPPORT SYSTEM

(75) Inventors: Martin Vysohlid, Schenectady, NY (US); Douglas Carl Hofer, Clifton Park, NY (US)

(73) Assignee: General Electric Company, Niskayuna, NY (US)

( * ) Notice: Subject to any disclaimer, the term of this patent is extended or adjusted under 35 U.S.C. 154(b) by 1000 days.

(21) Appl. No.: 12/901,010

(22) Filed: Oct. 8, 2010

(65) Prior Publication Data

US 2012/0087779 A1 Apr. 12, 2012

(51) Int. Cl.
*F04D 21/00* (2006.01)
*F04D 27/02* (2006.01)

(52) U.S. Cl.
CPC ..... *F04D 21/00* (2013.01); *F04D 27/02* (2013.01)

(58) Field of Classification Search
CPC ..... F04D 21/00; F04D 27/00; F04D 27/005; F04D 27/02; F04D 27/0261; F04D 27/0269; F05D 2260/85; F15B 11/17
USPC ..... 415/181, 182.1, 183, 184; 60/421, 428, 60/430
See application file for complete search history.

(56) References Cited

U.S. PATENT DOCUMENTS

| | | | | |
|---|---|---|---|---|
| 2,925,952 | A | 2/1960 | Garve | |
| 3,447,740 | A * | 6/1969 | Friberg | 415/181 |
| 3,797,239 | A * | 3/1974 | Hausmann et al. | 60/268 |
| 3,824,029 | A | 7/1974 | Fabri et al. | |
| 4,012,166 | A | 3/1977 | Kaesser et al. | |
| 4,199,296 | A | 4/1980 | de Chair | |
| 4,463,772 | A | 8/1984 | Ball | |
| 4,620,679 | A | 11/1986 | Karanian | |
| 4,704,861 | A | 11/1987 | Mowill | |

(Continued)

FOREIGN PATENT DOCUMENTS

| | | | |
|---|---|---|---|
| EP | 1126133 | A2 | 8/2001 |
| GB | 885661 | | 12/1961 |
| GB | 1523875 | A | 9/1978 |
| WO | 2009025803 | A1 | 2/2009 |
| WO | 20110075204 | A1 | 6/2011 |

OTHER PUBLICATIONS

Shawn P. Lawlor and Peter Baldwin, Conceptual Design of a Supersonic CO2 Compressor, Proceedings of ASME 2005, ASME Turbo Expo 2005, Jun. 6-9, 2005, 8 pages, Ramgen Power Systems, Bellevue, WA.

(Continued)

*Primary Examiner* — Dwayne J White
*Assistant Examiner* — Adam W Brown
(74) *Attorney, Agent, or Firm* — John P. Darling

(57) ABSTRACT

A supersonic compressor includes a fluid inlet, a fluid outlet, a fluid conduit extending therebetween, and at least one supersonic compressor rotor disposed within the fluid conduit and including a fluid flow channel that includes a throat portion. The supersonic compressor also includes a fluid control device coupled in fluid communication with at least one fluid source and an inlet of the fluid flow channel. The fluid control device channels a first fluid to the fluid flow channel inlet. The first fluid has a first plurality of fluid properties that facilitate attainment of supersonic flow of the first fluid in the throat portion during a first operational mode. The fluid control device further channels a second fluid to the fluid flow channel inlet. The second fluid has a second plurality of fluid properties that permit maintenance of supersonic flow of the second fluid in the throat portion.

6 Claims, 11 Drawing Sheets

(56) References Cited

U.S. PATENT DOCUMENTS

| | | | | |
|---|---|---|---|---|
| 5,525,038 | A | 6/1996 | Sharma et al. | |
| 5,881,758 | A | 3/1999 | Koncsek et al. | |
| 6,358,003 | B2 | 3/2002 | Schlechtriem | |
| 6,428,271 | B1 | 8/2002 | Ress, Jr. et al. | |
| 6,488,469 | B1 | 12/2002 | Yousser et al. | |
| 7,070,388 | B2 | 7/2006 | Meng et al. | |
| 7,293,955 | B2 | 11/2007 | Lawlor et al. | |
| 7,296,396 | B1 | 11/2007 | Wilson et al. | |
| 7,334,990 | B2 | 2/2008 | Lawlor et al. | |
| 7,337,606 | B2 | 3/2008 | Brouillette et al. | |
| 7,434,400 | B2 | 10/2008 | Lawlor et al. | |
| 2009/0107557 | A1 | 4/2009 | Conners | |
| 2009/0196731 | A1 * | 8/2009 | Lawlor | 415/1 |
| 2010/0005763 | A1 | 1/2010 | Bloom | |
| 2010/0043389 | A1 | 2/2010 | Conners | |

OTHER PUBLICATIONS

H.J. Lichtfuss, H. Starken, Supersonic Cascade Flow, Progress in Aerospace Sciences vol. 15, 1974, pp. 37-149.

M. F. El-Dosoky, A. Rona and J. P. Gostelow, An Analytical Model for Over-Shroud Leakage Losses in a Shrouded Turbine Stage, ASME Turbo Expo 2007, Power for Land, Sea and Air, GT2007, May 2007, pp. 1-10, Montreal Canada.

Allan D. Grosvenor, David A. Taylor, Jonathan R. Bucher, Michael J. Aarnio, Paul M. Brown, Robert D. Draper, Shawn P. Lawlor, Measured and Predicted Performance of a High Pressure Ratio Supersonic Compressor Rotor, ASME Turbo Expo 2008, Power for Land, Sea and Air, GT2008, Jun. 2008, pp. 1-12, Berlin, Germany.

European Search Report and Opinion issued in connection with corresponding EP Application No. 11184251.4 on Jan. 15, 2015.

* cited by examiner

320

| | GAMMA ($\gamma$) | MOLAR MASS [G/MOL] | SPEED OF SOUND [M/S] |
|---|---|---|---|
| AIR | 1.40 | 28.96 | 346 |
| $CO_2$ | 1.29 | 44.01 | 269 |
| $SF_6$ | 1.09 | 146.06 | 136 |
| $CH_4$ (METHANE) | 1.30 | 16.03 | 449 |
| $N_2$ | 1.40 | 28.02 | 352 |
| $C_3H_8$ (PROPANE) | 1.13 | 44.10 | 252 |
| $C_4H_{10}$ (BUTANE) | 1.09 | 58.12 | 216 |

FIG. 8

SUPERSONIC COMPRESSOR STARTUP SUPPORT SYSTEM

BACKGROUND

The subject matter described herein relates generally to supersonic compressor systems and, more particularly, to a supersonic compressor rotor for use with a supersonic compressor system.

At least some known supersonic compressor systems include a drive assembly, a drive shaft, and at least one supersonic compressor rotor for compressing a fluid. The drive assembly is coupled to the supersonic compressor rotor with the drive shaft to rotate the drive shaft and the supersonic compressor rotor.

Known supersonic compressor rotors include a plurality of vanes coupled to a rotor disk. Each vane is oriented circumferentially about the rotor disk and defines a flow channel between adjacent vanes. At least some known supersonic compressor rotors include a supersonic compression ramp that is coupled to the rotor disk. Known supersonic compression ramps are positioned within the flow path to form a throat region and are configured to form a compression wave, i.e., a shock wave within the flow path.

During starting operation of known supersonic compressor systems, the drive assembly rotates the supersonic compressor rotor at an initially low speed and accelerates the rotor to a high rotational speed. A fluid is channeled to the supersonic compressor rotor such that the fluid is characterized by a speed that is initially subsonic with respect to the supersonic compressor rotor at the flow channel throat and then, as the rotor accelerates, the fluid is characterized by a speed that is supersonic with respect to the supersonic compressor rotor at the flow channel throat. In known supersonic compressor rotors, as fluid is channeled through the flow channel, the supersonic compressor ramp causes formation of a system of oblique shock waves within a converging portion of the flow channel and a normal shock wave in a diverging portion of the flow channel. A throat region is defined in the narrowest portion of the flow channel between the converging and diverging portions. Wider throat regions facilitate establishing supersonic flow in the throat region during startup, but, decrease performance at steady-state. Narrower throat regions facilitate steady-state performance, but, increase a difficulty of establishing the supersonic flow in the throat region. Moreover, many known supersonic compressors have fixed throat geometries. Known supersonic compressor systems are described in, for example, U.S. Pat. Nos. 7,334,990 and 7,293,955 filed Mar. 28, 2005 and Mar. 23, 2005 respectively, and United States Patent Application 2009/0196731 filed Jan. 16, 2009.

BRIEF DESCRIPTION OF THE INVENTION

In one aspect, a supersonic compressor is provided. The supersonic compressor includes a fluid inlet, a fluid outlet, and a fluid conduit extending between the fluid inlet and the fluid outlet. The supersonic compressor also includes at least one supersonic compressor rotor disposed within the fluid conduit and includes a fluid flow channel including a throat portion. The supersonic compressor further includes a fluid control device coupled in fluid communication with at least one fluid source and a fluid flow channel inlet of the fluid flow channel. The fluid control device is configured to channel a first fluid to the fluid flow channel inlet. The first fluid has a first plurality of fluid properties that facilitate attainment of supersonic flow of the first fluid in the throat portion of the fluid flow channel during a first operational mode of the supersonic compressor. The fluid control device is further configured to channel a second fluid to the fluid flow channel inlet. The second fluid has a second plurality of fluid properties that permit maintenance of supersonic flow of the second fluid in the throat portion of the fluid flow channel In another aspect, a supersonic compressor startup support system is provided. The supersonic compressor startup support system includes at least one fluid source and a fluid control device coupled in fluid communication with the at least one fluid source and a fluid flow channel inlet of a fluid flow channel. The fluid control device is configured to channel a first fluid to the fluid flow channel inlet. The first fluid has a first plurality of fluid properties that facilitate attainment of supersonic flow of the first fluid in a throat portion of the fluid flow channel during a first operational mode of the supersonic compressor and the fluid control device. The fluid control device is further configured to channel a second fluid to the fluid flow channel inlet. The second fluid has a second plurality of fluid properties that permit maintenance of supersonic flow of the second fluid in the throat portion of the fluid flow channel during a second operational mode of the supersonic compressor and the fluid control device.

In yet another aspect, a method for starting a supersonic compressor is provided. The method includes providing a supersonic compressor that includes a fluid inlet coupled in fluid communication with at least one fluid source, a fluid outlet, a fluid conduit extending between the fluid inlet and the fluid outlet. The supersonic compressor also includes at least one supersonic compressor rotor disposed within the fluid conduit of the supersonic compressor and including a fluid flow channel including a throat portion and a fluid flow channel inlet. The method also includes channeling a first fluid from the at least one fluid source to the fluid flow channel inlet during a first operational mode of the supersonic compressor. The first fluid has a first plurality of fluid properties that permit attainment of a supersonic flow in the throat portion of the fluid flow channel during the first operational mode of the supersonic compressor. The method also includes accelerating the first fluid from initially subsonic flow to supersonic flow in the throat portion of the fluid flow channel during the first operational mode of the supersonic compressor. The method further includes channeling a second fluid from the at least one fluid source to the fluid flow channel inlet at a supersonic fluid speed during a second operational mode of the supersonic compressor. The second fluid has a second plurality of fluid properties that permit maintenance of supersonic flow of the second fluid in the throat portion of the fluid flow channel during the second operational mode of the supersonic compressor.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein:

FIG. 8 is a tabular view of a plurality of properties for a plurality of fluids that may be used with the supersonic compressor system shown in FIG. 1;

Figure 1:
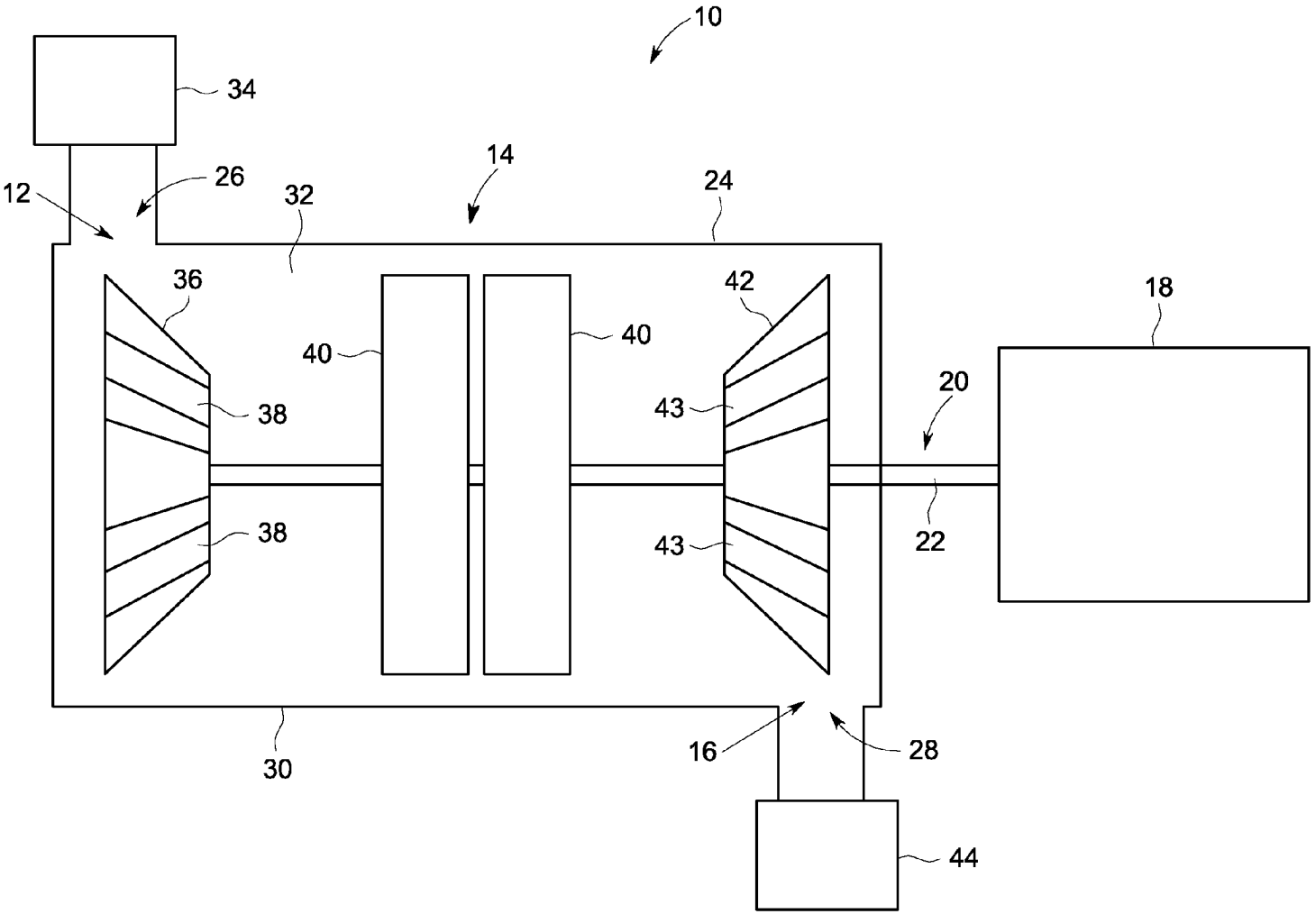
FIG. 1 is a schematic view of an exemplary supersonic compressor system.

Unless otherwise indicated, the drawings provided herein are meant to illustrate key inventive features of the invention. These key inventive features are believed to be applicable in a wide variety of systems comprising one or more embodiments of the invention. As such, the drawings are not meant to include all conventional features known by those of ordinary skill in the art to be required for the practice of the invention.

DETAILED DESCRIPTION OF THE INVENTION

In the following specification and the claims, which follow, reference will be made to a number of terms, which shall be defined to have the following meanings.

The singular forms "a", "an", and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about" and "substantially", are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

As used herein, the term "supersonic compressor rotor" refers to a compressor rotor comprising a supersonic compression ramp disposed within a fluid flow channel of the supersonic compressor rotor. Moreover, supersonic compressor rotors are "supersonic" because they are designed to rotate about an axis of rotation at high speeds such that a moving fluid, for example a moving gas, encountering the rotating supersonic compressor rotor at a supersonic compression ramp disposed within a flow channel of the rotor, is said to have a relative fluid velocity which is supersonic. The relative fluid velocity can be defined in terms of the vector difference of the fluid velocity just prior to encountering the supersonic compression ramp and the rotor velocity at the supersonic compression ramp. This relative fluid velocity is at times referred to as the "local supersonic inlet velocity", which in certain embodiments is a combination of an inlet gas velocity and a tangential speed of a supersonic compression ramp disposed within a flow channel of the supersonic compressor rotor. The supersonic compressor rotors are engineered for service at very high tangential speeds, for example tangential speeds in a range of 300 meters/second to 800 meters/second.

The exemplary systems and methods described herein overcome disadvantages of known supersonic compressors by providing a supersonic compressor startup support system that channels fluids to the supersonic compressors during startup and steady state operation that facilitate attaining and maintenance of supersonic flow in the channel throat. Specifically, the startup support system includes at least one fluid source and a fluid control device coupled in fluid communication with the at least one fluid source and a fluid flow channel inlet of a fluid flow channel. More specifically, the fluid control device channels a first fluid through the supersonic compressor that has fluid properties that facilitate attainment of supersonic flow of the first fluid in a throat portion of the fluid flow channel during a first operational mode of the supersonic compressor, that is, startup operations. Also, more specifically, the fluid control device channels a second fluid through the supersonic compressor that has fluid properties that permit maintenance of supersonic flow of the second fluid in the throat portion of the fluid flow channel during a second operational mode of the supersonic compressor, that is, steady-state operations.

FIG. 1 is a schematic view of an exemplary supersonic compressor system 10 (also at times herein referred to as a supersonic compressor). In the exemplary embodiment, supersonic compressor system 10 includes an intake section 12, a compressor section 14 coupled downstream from intake section 12, a discharge section 16 coupled downstream from compressor section 14, and a drive assembly 18. Compressor section 14 is coupled to drive assembly 18 by a rotor assembly 20 that includes a drive shaft 22. In the exemplary embodiment, each of intake section 12, compressor section 14, and discharge section 16 are positioned within a compressor housing 24. More specifically, compressor housing 24 includes a fluid inlet 26, a fluid outlet 28, and an inner surface 30 that defines a cavity 32. Cavity 32 extends between fluid inlet 26 and fluid outlet 28 and is configured to channel a fluid from fluid inlet 26 to fluid outlet 28. Each of intake section 12, compressor section 14, and discharge section 16 are positioned within cavity 32. Alternatively, intake section 12 and/or discharge section 16 may not be positioned within compressor housing 24.

In the exemplary embodiment, fluid inlet 26 is configured to channel a flow of fluid from a fluid source 34 to intake section 12. The fluid may be any fluid such as, for example a gas, a gas mixture, and/or a liquid-gas mixture. Intake section 12 is coupled in flow communication with compressor section 14 for channeling fluid from fluid inlet 26 to compressor section 14. Intake section 12 is configured to condition a fluid flow having one or more predetermined parameters, such as a velocity, a mass flow rate, a pressure, a temperature, and/or any suitable flow parameter. In the exemplary embodiment, intake section 12 includes an inlet guide vane assembly 36 that is coupled between fluid inlet 26 and compressor section 14 for channeling fluid from fluid inlet 26 to compressor section 14. Inlet guide vane assembly 36 includes one or more inlet guide vanes 38 that are coupled to compressor housing 24 and are stationary with respect to compressor section 14.

Compressor section 14 is coupled between intake section 12 and discharge section 16 for channeling at least a portion of fluid from intake section 12 to discharge section 16. Compressor section 14 includes at least one supersonic compressor rotor 40 that is rotatably coupled to drive shaft 22. Supersonic compressor rotor 40 is configured to increase a pressure of fluid, reduce a volume of fluid, and/or increase a temperature of fluid being channeled to discharge section 16. Discharge section 16 includes an outlet guide vane assembly 42 that is coupled between supersonic compressor rotor 40 and fluid outlet 28 for channeling fluid from supersonic compressor rotor 40 to fluid outlet 28. Outlet guide vane assembly 42 includes one or more outlet guide vanes 43 that are coupled to compressor housing 24 and are stationary with respect to compressor section 14. Fluid outlet 28 is configured to channel fluid from outlet guide vane assembly 42 and/or supersonic compressor rotor 40 to an output system 44 such as, for example, a turbine engine system, a fluid treatment system, and/or a fluid storage system. In one embodiment, drive assembly 18 may be configured to rotate drive shaft 22 to cause a rotation of inlet guide vane assembly 36, supersonic compressor rotor 40, and/or outlet guide vane assembly 42.

During operation, intake section 12 channels fluid from fluid source 34 towards compressor section 14. Compressor section 14 compresses the fluid and discharges the compressed fluid towards discharge section 16. Discharge section 16 channels the compressed fluid from compressor section 14 to output system 44 through fluid outlet 28.

Figure 2:
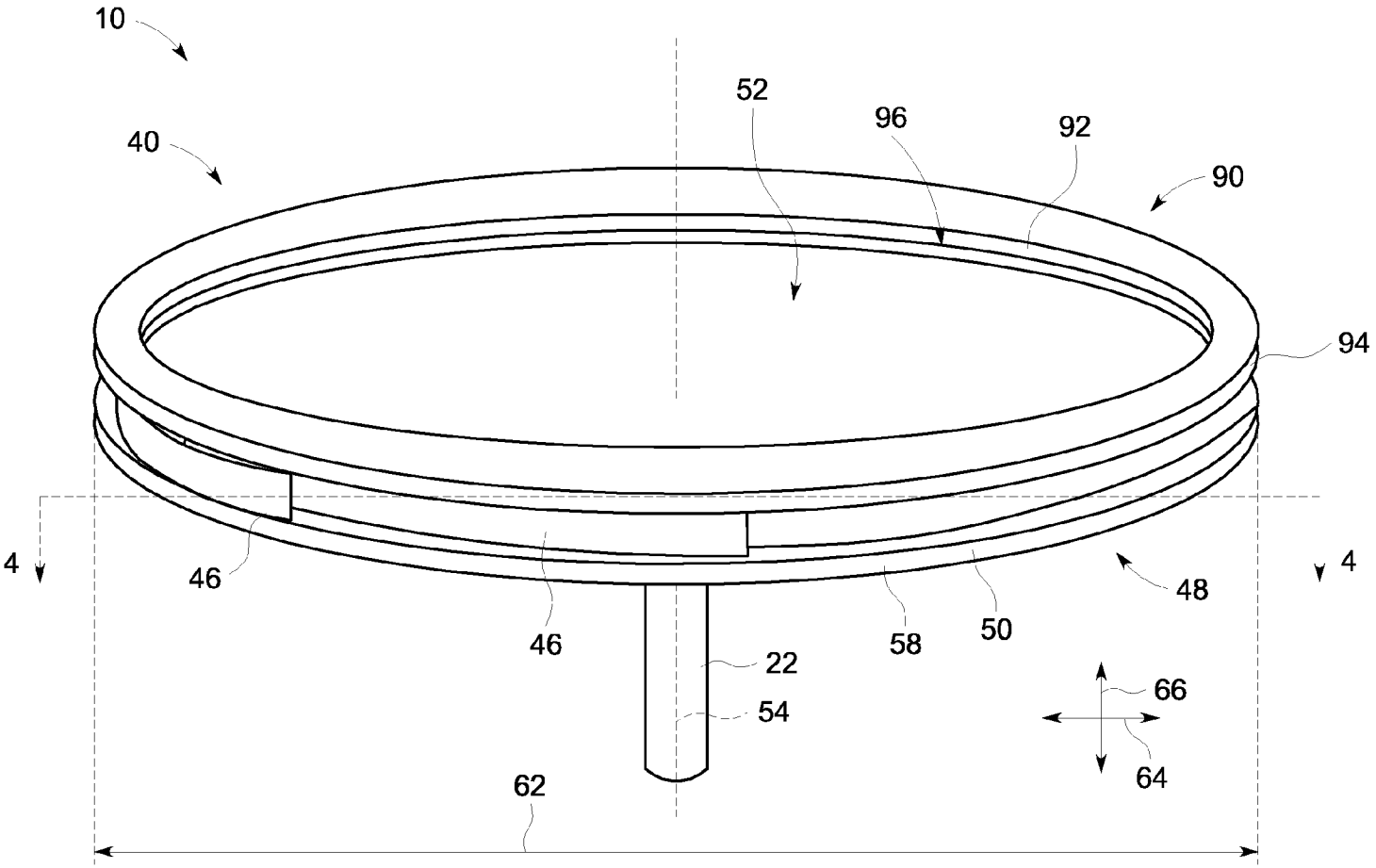
FIG. 2 is a perspective view of an exemplary supersonic compressor rotor that may be used with the supersonic compressor system shown in FIG. 1.
Figure 3:
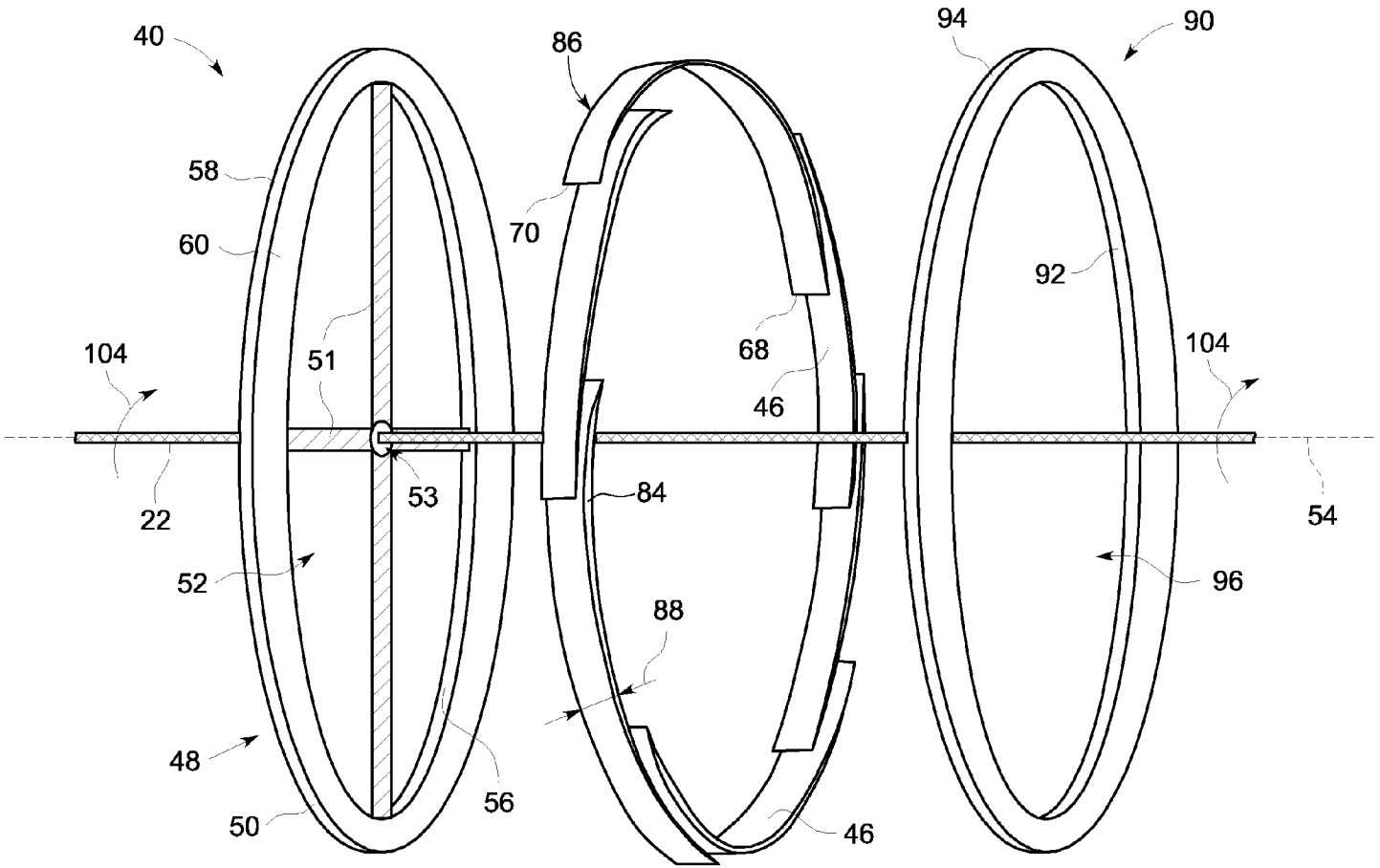
FIG. 3 is an exploded perspective view of the supersonic compressor rotor shown in FIG. 2.
Figure 4:
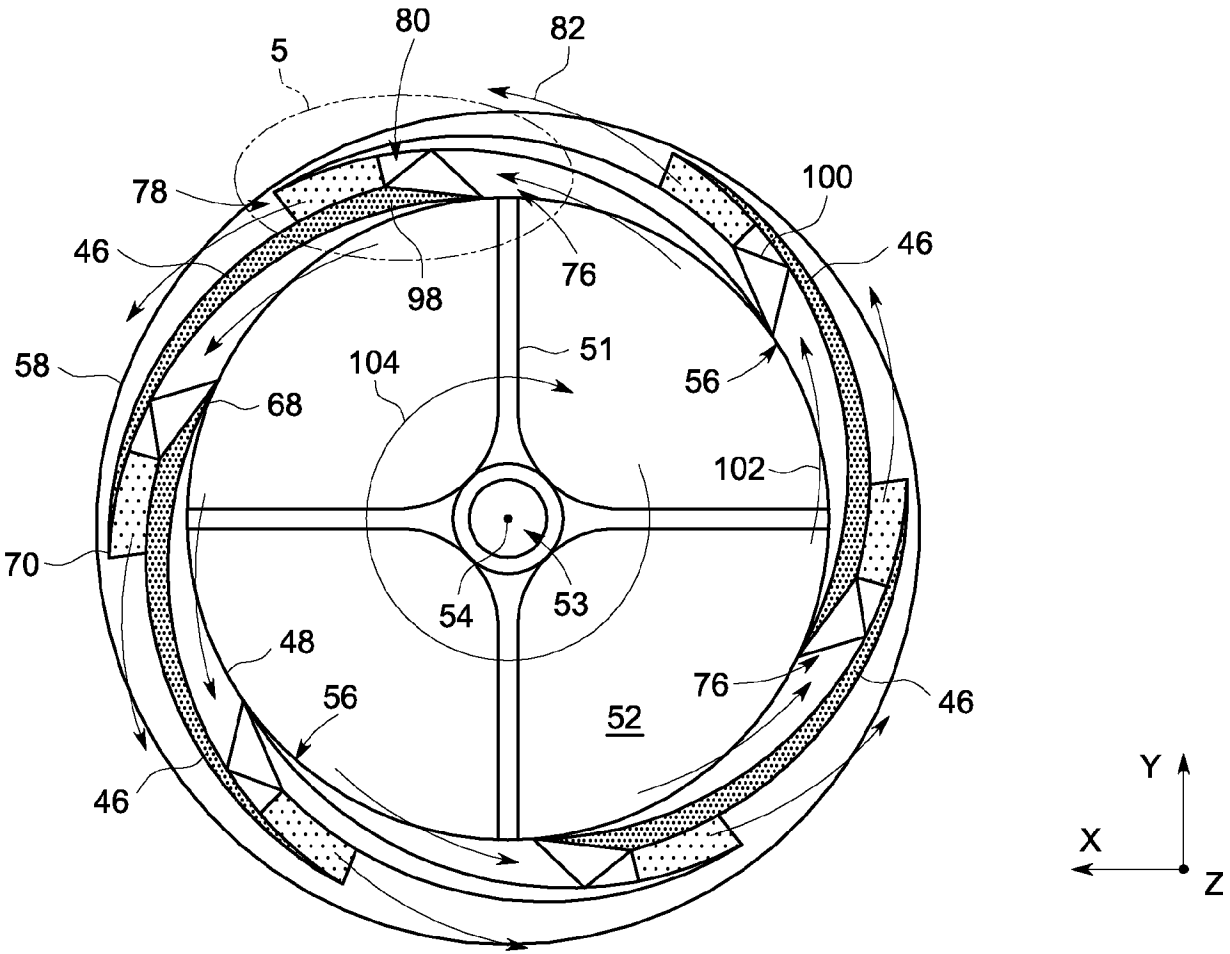
FIG. 4 is a cross-sectional view of the supersonic compressor rotor shown in FIG. 2 and taken along line 4-4.

FIG. 2 is a perspective view of an exemplary supersonic compressor rotor 40. FIG. 3 is an exploded perspective view of supersonic compressor rotor 40. FIG. 4 is a cross-sectional view of supersonic compressor rotor 40 taken along sectional line 4-4 shown in FIG. 2. Identical components shown in FIG. 3 and FIG. 4 are labeled with the same reference numbers used in FIG. 2. For purposes of clarity, FIG. 4 shows an x-axis to illustrate a first radial dimension, a y-axis to illustrate a second radial dimension that is perpendicular to the x-axis, and a z-axis to illustrate an axial dimension that is perpendicular to the x-axis and the y-axis. These reference axes will be used hereon. In FIG. 4, the z-axis is directed out of the page. In the exemplary embodiment, supersonic compressor rotor 40 includes a plurality of vanes 46 that are coupled to a rotor disk 48. Rotor disk 48 includes an annular disk body 50 that defines an inner cavity 52 extending generally axially through disk body 50 along a centerline axis 54. Disk body 50 includes a radially inner surface 56, a radially outer surface 58, and an endwall 60. Radially inner surface 56 defines inner cavity 52. Inner cavity 52 has a substantially cylindrical shape and is oriented about centerline axis 54. Drive shaft 22 is rotatably coupled to rotor disk 48 via a plurality of rotor support struts 51 that define an aperture 53 through which drive shaft 22 is inserted. Endwall 60 extends radially outwardly from inner cavity 52 and between radially inner surface 56 and radially outer surface 58. Endwall 60 includes a width 62 defined in a radial direction 64 that is oriented perpendicular to centerline axis 54.

In the exemplary embodiment, each vane 46 is coupled to endwall 60 and extends outwardly from endwall 60 in an axial direction 66 that is generally parallel to centerline axis 54. Each vane 46 includes an inlet edge 68 and an outlet edge 70. Inlet edge 68 is positioned adjacent radially inner surface 56. Outlet edge 70 is positioned adjacent radially outer surface 58. In the exemplary embodiment, supersonic compressor rotor 40 includes a pair 74 of vanes 46. Each vane 46 is oriented to define an inlet opening 76, an outlet opening 78, and a flow channel 80 between each pair 74 of adjacent vanes 46. Flow channel 80 extends between inlet opening 76 and outlet opening 78 and defines a flow path, represented by arrow 82, (shown in FIG. 4) from inlet opening 76 to outlet opening 78. Flow path 82 is oriented generally parallel to vane 46. Flow channel 80 is sized, shaped, and oriented to channel fluid along flow path 82 from inlet opening 76 to outlet opening 78 in radial direction 64. Inlet opening 76 is defined between adjacent inlet edges 68 of adjacent vanes 46. Outlet opening 78 is defined between adjacent outlet edges 70 of adjacent vanes 46. Each vane 46 extends radially between inlet edge 68 and outlet edge 70 such that each vane 46 extends between radially inner surface 56 and radially outer surface 58. Also, each vane 46 includes an outer surface 84 and an opposite inner surface 86. Vane 46 extends between outer surface outer surface 84 and inner surface 86 to define an axial height 88 of flow channel 80.

Referring to FIG. 2 and FIG. 3, in the exemplary embodiment, a shroud assembly 90 is coupled to outer surface 84 of each vane 46 such that flow channel 80 (shown in FIG. 4) is defined between shroud assembly 90 and endwall 60. Shroud assembly 90 includes an inner edge 92 and an outer edge 94. Inner edge 92 defines a substantially cylindrical opening 96. Shroud assembly 90 is oriented coaxially with rotor disk 48, such that inner cylindrical cavity 52 is concentric with opening 96. Shroud assembly 90 is coupled to each vane 46 such that inlet edge 68 of vane 46 is positioned adjacent inner edge 92 of shroud assembly 90, and outlet edge 70 of vane 46 is positioned adjacent outer edge 94 of shroud assembly 90. Alternatively, supersonic compressor rotor 40 does not include shroud assembly 90. In such an embodiment, a diaphragm assembly (not shown) is positioned adjacent each outer surface 84 of vanes 46 such that the diaphragm at least partially defines flow channel 80.

Referring to FIG. 4, in the exemplary embodiment, at least one supersonic compression ramp 98 is positioned within flow channel 80. Supersonic compression ramp 98 is positioned between inlet opening 76 and outlet opening 78, and is sized, shaped, and oriented to enable one or more shock waves 100 to form within flow channel 80.

During operation of supersonic compressor rotor 40, intake section 12 (shown in FIG. 1) channels a fluid 102 towards inlet opening 76 of flow channel 80. Fluid 102 has a first velocity, i.e., an approach velocity, just prior to entering inlet opening 76. Supersonic compressor rotor 40 is rotated about centerline axis 54 at a second velocity, i.e., a rotational velocity, represented by directional arrow 104, such that fluid 102 entering flow channel 80 has a third velocity, i.e., an inlet velocity at inlet opening 76 that is supersonic relative to vanes 46. As fluid 102 is channeled through flow channel 80 at a supersonic velocity, supersonic compression ramp 98 enables shock waves 100 to form within flow channel 80 to facilitate compressing fluid 102, such that fluid 102 includes an increased pressure and temperature, and/or includes a reduced volume at outlet opening 78.

Figure 5:
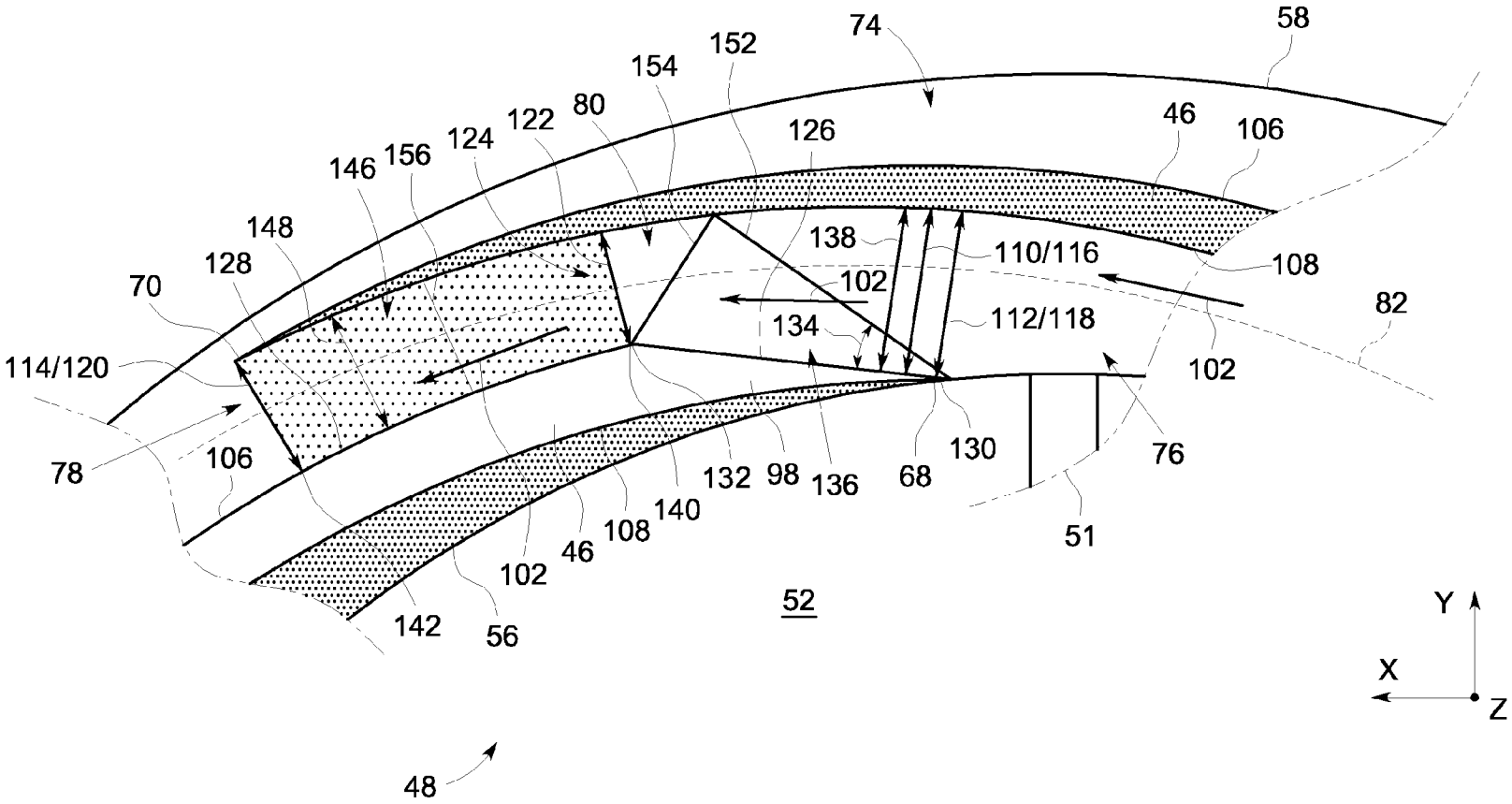
FIG. 5 is an enlarged cross-section view of a portion of the supersonic compressor rotor shown in FIG. 4 and taken along area 5.

FIG. 5 is an enlarged cross-sectional view of a portion of supersonic compressor rotor 40 taken along area 5 shown in FIG. 4. Identical components shown in FIG. 5 are labeled with the same reference numbers used in FIG. 2 and FIG. 4. For purposes of clarity, FIG. 5 shows an x-axis to illustrate a first radial dimension, a y-axis to illustrate a second radial dimension that is perpendicular to the x-axis, and a z-axis to illustrate an axial dimension that is perpendicular to the x-axis and the y-axis. In FIG. 5, the z-axis is directed out of the page. In the exemplary embodiment, each vane 46 includes a first, or pressure side 106 and an opposing second, or suction side 108. Each pressure side 106 and suction side 108 extends between inlet edge 68 and outlet edge 70.

In the exemplary embodiment, each vane 46 is spaced circumferentially about inner cylindrical cavity 52 such that flow channel 80 is oriented generally radially between inlet opening 76 and outlet opening 78. Each inlet opening 76 extends between a pressure side 106 and an adjacent suction side 108 of vane 46 at inlet edge 68. Each outlet opening 78 extends between pressure side 106 and an adjacent suction side 108 at outlet edge 70, such that flow path 82 is defined radially outwardly from radially inner surface 56 to radially outer surface 58 in radial direction 64. Alternatively, adjacent vanes 46 may be oriented such that inlet opening 76 is defined at radially outer surface 58 and outlet opening 78 is defined at radially inner surface 56 such that flow path 82 is defined radially inwardly from radially outer surface 58 to radially inner surface 56. In the exemplary embodiment, flow channel 80 includes a circumferential width 110 that is defined between pressure side 106 and adjacent suction side 108 and is perpendicular to flow path 82. Inlet opening 76 has a first circumferential width 112 that is larger than a second circumferential width 114 of outlet opening 78. Alternatively, first circumferential width 112 of inlet opening 76 may be less than, or equal to, second circumferential width 114 of outlet opening 78. In the exemplary embodiment, each vane 46 is formed with an arcuate shape and is oriented such that flow channel 80 is defined with a spiral shape and generally converges inwardly between inlet opening 76 to outlet opening 78.

In the exemplary embodiment, flow channel 80 defines a cross-sectional area 116 that varies along flow path 82. Cross-sectional area 116 of flow channel 80 is defined perpendicularly to flow path 82 and is equal to circumferential width 110 of flow channel multiplied by axial height 88 (shown in FIG. 3) of flow channel 80. Flow channel 80 includes a first area, i.e., an inlet cross-sectional area 118 at inlet opening 76, a second area, i.e., an outlet cross-sectional area 120 at outlet opening 78, and a third area, i.e., a minimum cross-sectional area 122 that is defined between inlet opening 76 and outlet opening 78. In the exemplary embodiment, minimum cross-sectional area 122 is less than inlet cross-sectional area 118 and outlet cross-sectional area 120. In one embodiment, minimum cross-sectional area 122 is equal to outlet cross-sectional area 120, wherein each of outlet cross-sectional area 120 and minimum cross-sectional area 122 is less than inlet cross-sectional area 118.

In the exemplary embodiment, supersonic compression ramp 98 is coupled to pressure side 106 of vane 46 and defines a throat region 124 of flow channel 80. Throat region 124 defines minimum cross-sectional area 122 of flow channel 80. In an alternative embodiment, supersonic compression ramp 98 may be coupled to suction side 108 of vane 46, endwall 60, and/or shroud assembly 90. In a further alternative embodiment, supersonic compressor rotor 40 includes a plurality of supersonic compression ramps 98 that are each coupled to pressure side 106, suction side 108, endwall 60, and/or shroud assembly 90. In such an embodiment, each supersonic compression ramp 98 collectively defines throat region 124.

In the exemplary embodiment, throat region 124 defines minimum cross-sectional area 122 that is less than inlet cross-sectional area 118 such that flow channel 80 has an area ratio defined as a ratio of inlet cross-sectional area 118 divided by minimum cross-sectional area 122 of between about 1.01 and 1.10. In one embodiment, the area ratio is between about 1.07 and 1.08.

In the exemplary embodiment, supersonic compression ramp 98 includes a compression surface 126 and a diverging surface 128. Compression surface 126 includes a first, or leading edge 130 and a second, or trailing edge 132. Leading edge 130 is positioned closer to inlet opening 76 than trailing edge 132. Compression surface 126 extends between leading edge 130 and trailing edge 132 and is oriented at an oblique angle 134 from vane 46 into flow path 82. Compression surface 126 converges towards an adjacent suction side 108 such that a compression region 136 is defined between leading edge 130 and trailing edge 132. Compression region 136 includes a cross-sectional area 138 of flow channel 80 that is reduced along flow path 82 from leading edge 130 to trailing edge 132. Trailing edge 132 of compression surface 126 defines throat region 124.

Diverging surface 128 is coupled to compression surface 126 and extends downstream from compression surface 126 towards outlet opening 78. Diverging surface 128 includes a first end 140 and a second end 142 that is closer to outlet opening 78 than first end 140. First end 140 of diverging surface 128 is coupled to trailing edge 132 of compression surface 126. Diverging surface 128 extends between first end 140 and second end 142. Diverging surface 128 defines a diffusion region 146 that includes a diverging cross-sectional area 148 that increases from second end 132 of compression surface 126 to outlet opening 78. Diffusion region 146 extends from throat region 124 to outlet opening 78. In an alternative embodiment, supersonic compression ramp does not include diverging surface 128. In this alternative embodiment, trailing edge 132 of compression surface 126 is positioned adjacent outlet edge 70 of vane 46 such that throat region 124 is defined adjacent outlet opening 78.

During operation of supersonic compressor rotor 40, fluid 102 is channeled from inner cylindrical cavity 52 into inlet opening 76 at a supersonic velocity with respect to rotor disk 48. Fluid 102 entering flow channel 80 from inner cylindrical cavity 52 contacts leading edge 130 of supersonic compression ramp 98 to form a first oblique shock wave 152. Compression region 136 of supersonic compression ramp 98 is configured to cause first oblique shock wave 152 to be oriented at an oblique angle with respect to flow path 82 from leading edge 130 towards adjacent vane 46, and into flow channel 80. As first oblique shock wave 152 contacts adjacent vane 46, a second oblique shock wave 154 is reflected from adjacent vane 46 at an oblique angle with respect to flow path 82, and towards throat region 124 of supersonic compression ramp 98. In one embodiment, compression surface 126 is oriented to cause second oblique shock wave 154 to extend from first oblique shock wave 152 at adjacent vane 46 to trailing edge 132 that defines throat region 124. Supersonic compression ramp 98 is configured to cause each first oblique shock wave 152 and second oblique shock wave 154 to form within compression region 136.

As fluid 102 passes through compression region 136, a speed of fluid 102 is reduced as fluid 102 passes through each first oblique shock wave 152 and second oblique shock wave 154. In addition, a pressure of fluid 102 is increased, and a volume of fluid 102 is decreased. In the exemplary embodiment, as fluid 102 passes through throat region 124, supersonic compression ramp 98 is configured to condition fluid 102 to have an outlet velocity at outlet opening 78 that is supersonic with respect to rotor disk 48. Supersonic compression ramp 98 is further configured to cause a normal shock wave 156 to form downstream of throat region 124 and within flow channel 80. Normal shock wave 156 is a shock wave oriented perpendicular to flow path 82 that reduces a speed of fluid 102 to a subsonic speed with respect to rotor disk 48 as fluid passes through normal shock wave 156.

Figure 6:
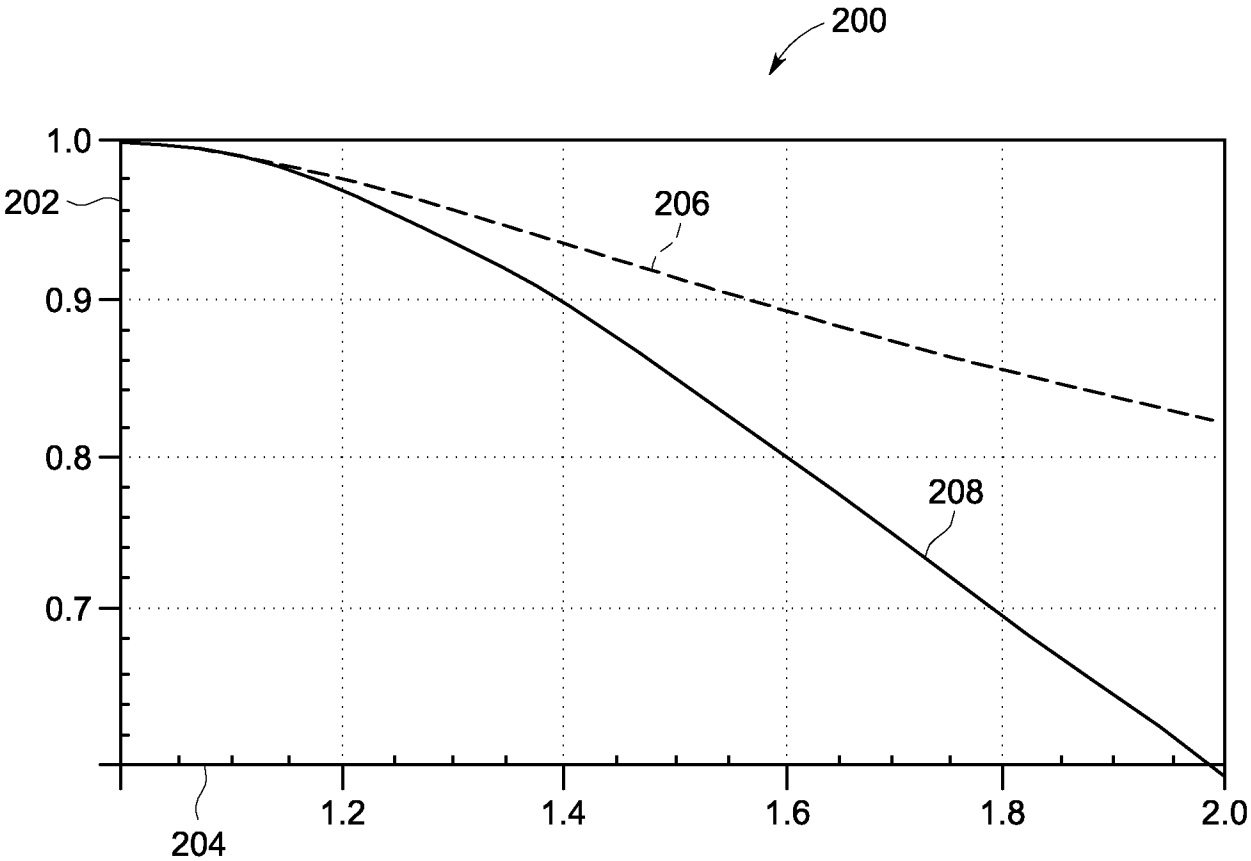
FIG. 6 is a graphical view of a relationship between a throat area and a Mach number for air for various conditions for the supersonic compressor rotor shown in FIGS. 4 and 5.

FIG. 6 is a graphical view 200 of a relationship between a throat area and a relative Mach number at the throat area for air for various conditions for supersonic compressor rotor 40

(shown in FIGS. 4 and 5). Relative Mach number is defined as a ratio of the speed of a fluid medium in the coordinate system of the rotor to the speed of sound in such fluid medium, therefore, the speed of sound in the fluid medium is the reference. In general, supersonic compressors have two high level operating modes, that is, a starting, or startup mode, and a steady-state operating mode. In the startup mode, a supersonic compressor rotor is accelerated from a stationary condition to a relatively high rotational speed. The speed of fluid introduced to the supersonic compressor with respect to the rotor is initially subsonic and it increases during the startup mode as the rotational speed of the rotor increases. In steady-state operating mode, the supersonic compressor rotor is rotating at a substantially constant rotational speed and it is compressing the associated fluids, which have supersonic speeds in the coordinate system of the rotor.

Therefore, in general, startup modes and steady-state modes of operation of supersonic compressors typically require different fluid flow channel geometries. Specifically, to facilitate attainment of supersonic speed in the throat and forming a normal shock wave downstream of the throat region in the fluid flow channel during startup, a larger, or wider throat area is required in contrast to a smaller, or narrower throat area required for maintenance of the normal shock wave downstream of the throat region during steady-state operations. Wider throat regions facilitate establishing supersonic flow in the throat region during startup, however, decrease performance at steady-state. Narrower throat regions facilitate steady-state performance, but, increase a difficulty of establishing the supersonic flow in the throat region during startup.

Graph 200 includes an ordinate, that is, a y-axis 202 that represents numerical values for a ratio of throat area (A*) to an inlet area ($A_{inlet}$) in unitless increments of 0.1 from 0.6 to 1.0. Graph 200 is plotted with an adoption of a perfect inviscid gas assumption to illustrate the mechanisms described herein, wherein it is understood that plots for real gases may differ to some extent, however, substantially similar behaviors are expected to be observed with substantially similar benefits attained. Graph 200 also includes an abscissa, that is, an x-axis 204 that represents numerical values for fluid velocities as a Mach number in increments of 0.2 from 1.0 to 2.0. Graph 200 further includes a starting curve 206 for air that represents a minimum throat area-to-inlet area ratio for starting operation of supersonic compressor rotor 40. This means that for a constant $A_{inlet}$, starting curve 206 is proportional to the minimum throat area required to facilitate supersonic fluid flow during starting conditions with formation/maintenance of the oblique and normal shock waves as the rotor increases its rotational speed and a relative Mach number of the fluid increases correspondingly therewith. For example, a minimum value of an A*-to-$A_{inlet}$ ratio for relative fluid speed with a Mach number of 1.8 during startup is approximately 0.85, that is, given a constant $A_{inlet}$, a value for A* is approximately 85% of the value for $A_{inlet}$. Therefore, to establish and maintain a proper normal shock wave for these circumstances, a minimum value for the throat area is 85% of the value of the inlet area.

Starting curve 206 is contrasted to a steady-state operating curve 208 for air that represents a minimum A*-to-$A_{inlet}$ ratio for steady-state operation of supersonic compressor rotor 40. This means that for a constant $A_{inlet}$, curve 208 is proportional to the minimum throat area required to facilitate supersonic fluid flow during steady-state conditions with maintenance of the oblique and normal shock waves as the rotor maintains its rotational speed and a relative Mach number of the fluid is maintained correspondingly therewith. For example, a minimum value of an A*-to-$A_{inlet}$ ratio for a Mach number of 1.8 during steady-state operation is approximately 0.70, that is, given a constant $A_{inlet}$, a value for A* is approximately 70% of the value for $A_{inlet}$. Therefore, given a constant $A_{inlet}$, steady-state operation can have smaller A* than does startup operation.

Figure 7:
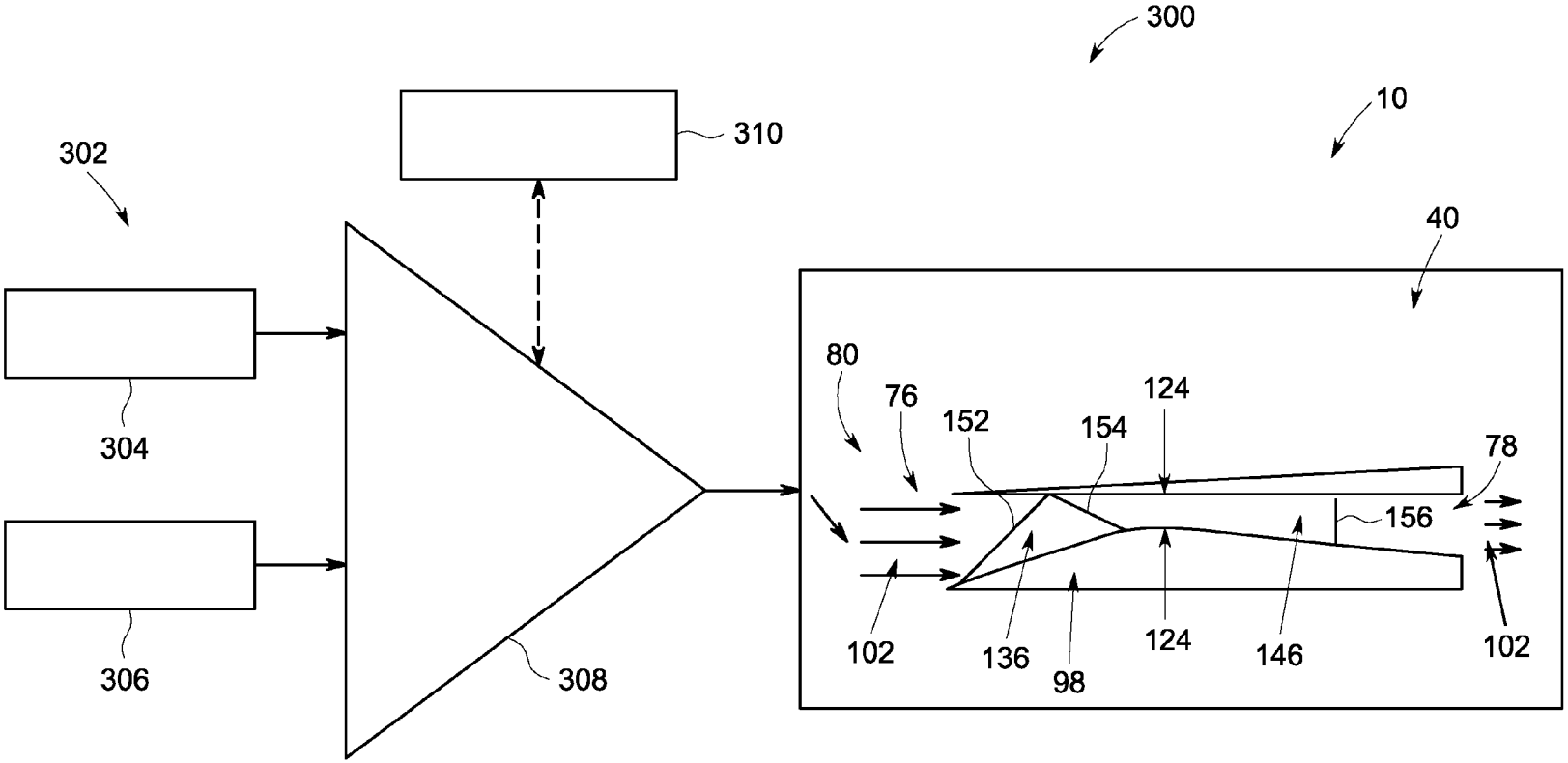
FIG. 7 is a schematic cross-sectional view of an exemplary supersonic compressor startup support system that may be used with the supersonic compressor system shown in FIG. 1.

FIG. 7 is a schematic cross-sectional view of an exemplary supersonic compressor startup support system 300 that may be used with supersonic compressor system 10. FIG. 7 shows a portion of supersonic compressor rotor 40. In the exemplary embodiment, and as discussed further below, startup support system 300 facilitates a transition from startup mode to steady-state operating mode by modulating an effective throat area by using a first, or starting fluid during startup and shifting to a second, or steady-state fluid as the supersonic compressor rotor accelerates to steady-state operations.

In the exemplary embodiment, startup support system 300 includes a plurality of fluid sources 302. Also, in the exemplary embodiment, there are two fluid sources, that is, a first, or startup fluid source 304 and a second, or steady-state fluid source 306, wherein use of a plurality of fluids is discussed further below. Startup support system 300 also includes a fluid control device 308 that includes sufficient fluid flow control devices (not shown) to enable operation of startup support system 300 as described herein including, without limitation, valving, piping, flow restrictors, pumps, motors, and electric, pneumatic, and/or hydraulic power supplies. Fluid control device 308 is coupled in fluid communication with inlet opening 76 of flow channel 80.

Startup support system 300 further includes a control system 310 that is operatively coupled to fluid control device 308, wherein control system 310 is programmed with sufficient analog and discrete logic, including algorithms, and implemented in a manner that enables operation of supersonic compressor startup support system 300, including fluid control device 308, as described herein. In the exemplary embodiment, control system 300 includes at least one processor including, without limitation, those processors resident within personal computers, remote servers, programmable logic controllers (PLCs), and distributed control system (DCS) cabinets.

In operation, and as described in more detail below, supersonic compressor startup support system 300 channels a startup fluid (not shown) from startup fluid source 304 to inlet opening 76. Control system 310 modulates fluid control device 308 to channel the starting fluid through supersonic compressor rotor 40 until predetermined conditions including, without limitation, rotational speed of rotor and startup fluid speed, are attained. Once the predetermined startup fluid speed is attained, control system 310 will facilitate maintenance of supersonic fluid flow within fluid flow channel 80 as a steady-state fluid (not shown) is channeled from steady-state fluid source 306 in parallel with the startup fluid from startup fluid source 304. Control system 310 and fluid control device 308 modulate steady-state fluid flow in an increasing manner while modulating starting fluid flow in a decreasing manner, thereby gradually substituting the steady-state fluid for the startup fluid while maintaining proper shock wave formation within fluid flow channel 80. As the fluid substitution approaches completion, starting fluid flow is substantially stopped and fluid flow through fluid flow channel 80 is substantially steady-state fluid flow, and control system 310 and fluid control device 308 resume acceleration or deceleration of supersonic compressor rotor 40 until predetermined parameters are attained including, without limitation, fluid speeds, rotational speeds of rotor 40, and compression ratios.

Alternatively, rather than holding supersonic compressor rotor 40 at a substantially static condition, rotor 40 is accelerated throughout the starting fluid-to-steady-state fluid substitution.

FIG. 8 is a tabular view, or table 320, of a plurality of properties for a plurality of fluids that may be used with supersonic compressor system 10 and supersonic compressor startup support system 300 (both shown in FIG. 7). Table 320 shows three property values for each of a plurality of fluids listed therein at a pressure of one atmosphere (101.3 kilopascal (kPa), 14.7 pounds per square inch (psi)) and a temperature of 25 degrees Celsius (° C.) (77 degrees Fahrenheit (° F.), 298 degrees Kelvin (° K)). The fluids listed in table 320 are air, carbon dioxide ($CO_2$), sulfur hexafluoride ($SF_6$), methane ($CH_4$), nitrogen ($N_2$), propane ($C_3H_8$), and butane ($C_4H_{10}$). A first property of such fluids is the gamma ($\gamma$) value. $\gamma$ is a unitless value that represents an isentropic exponent coefficient determined by a ratio of a specific heat coefficient at constant pressure, that is, $C_p$, to a specific heat coefficient at constant volume, that is, $C_v$. Supersonic compressor minimum throat area values are determined as a function of $\gamma$ and relative Mach number, that is, a ratio of a relative speed of a fluid medium to the speed of sound in the selected fluid medium. A second property of the fluids listed in table 320 is molar mass in units of grams per more (g/mol). A third property of the fluids listed in table 320 is the speed of sound in units of meters per second (m/s) in the fluid. In general, the speed of sound in a fluid is a function of properties that include, without limitation, fluid composition and temperature. For example, the speed of sound of 346 m/s in air at one atmosphere and 298° K is greater than the speed of sound of 269 m/s in $CO_2$ at one atmosphere and 298° K.

Figure 9:
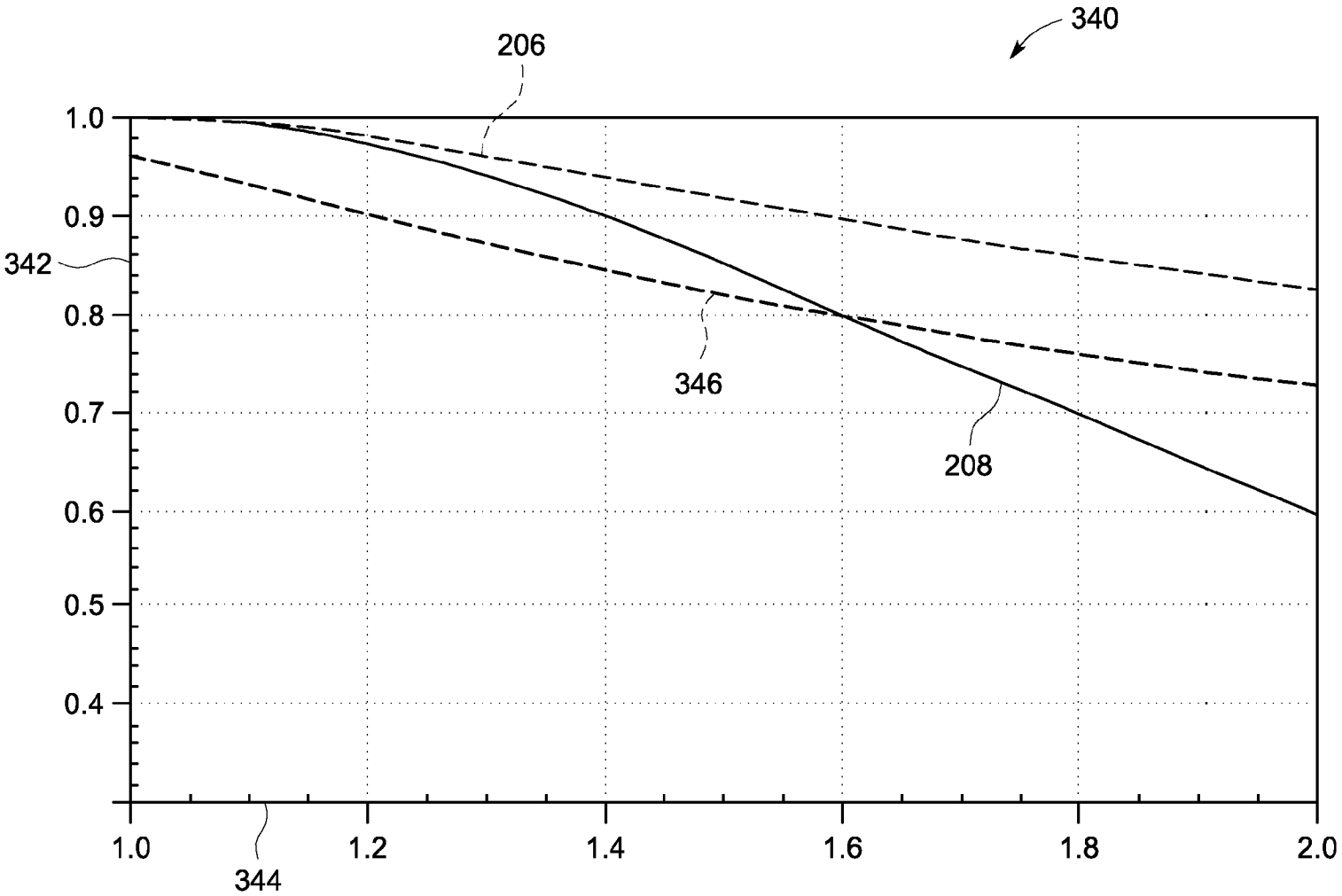
FIG. 9 is a graphical view of a relationship between a throat area and a Mach number for air and carbon dioxide for various conditions for the supersonic compressor rotor shown in FIGS. 4 and 5.

FIG. 9 is a graphical view 340 of a relationship between a throat area and a relative flow speed for air and $CO_2$ for various conditions for supersonic compressor rotor 40 (shown in FIGS. 4 and 5). Graph 340 is plotted with an adoption of a perfect inviscid gas assumption to illustrate the mechanisms described herein, wherein it is understood that plots for real gases may differ to some extent, however, substantially similar behaviors are expected to be observed with substantially similar benefits attained. Graph 340 includes an ordinate, that is, a y-axis 342 that represents numerical values for a ratio of throat area (A*) to an inlet area ($A_{inlet}$) in unitless increments of 0.1 from 0.3 to 1.0. Graph 340 also includes an abscissa, that is, an x-axis 344 that represents numerical values for fluid speed normalized by speed of sound in air in increments of 0.2 from 1.0 to 2.0 such that X-axis 344 represents a relative Mach number for air, but not for $CO_2$. Graph 340 further includes starting curve 206 for air and steady-state operating curve 208 for air, both as described above in FIG. 6.

Graph 340 also includes a starting curve 346 for $CO_2$ that represents a minimum throat area-to-inlet area ratio for starting operation of supersonic compressor rotor 40. For a constant $A_{inlet}$, starting curve 346 is proportional to the minimum throat area required to facilitate supersonic $CO_2$ flow during starting conditions, and also to facilitate formation/maintenance of oblique and normal shock waves as the rotor increases its rotational speed and a relative Mach number of $CO_2$ flow (not shown in FIG. 9) increases correspondingly therewith. For purposes of illustration, a minimum value of an A*-to-$A_{inlet}$ ratio for a relative fluid speed corresponding to a Mach number (based on a relative speed of sound in air) of 1.8 during startup with $CO_2$ is approximately 0.76, that is, given a constant $A_{inlet}$, a value for A* is approximately 76% of the value for $A_{inlet}$.

Therefore, startup with $CO_2$ as a starting gas facilitates initiation of supersonic flow within a throat area smaller than what would be required to start with air. Given a constant throat area, once startup is completed, that is, the supersonic compressor rotor is at a maintenance rotational speed, air may be gradually substituted for $CO_2$ until steady-state operation is exclusively being conducted with air. More specifically, as indicated by the intersection of curves 208 and 346, once the fluid at the throat attains a supersonic speed corresponding to a Mach number of 1.6 in air, a value for a minimum A*-to-$A_{inlet}$ ratio of approximately 0.8 is the same for startup with $CO_2$ and for steady-state operation with air. Therefore supersonic compressor rotor 40 with an A*-to-$A_{inlet}$ ratio of approximately 0.8 can be started with $CO_2$ fluid, then the rotor rotational speed can be increased so that the relative speed of the $CO_2$ fluid at the throat attains a speed corresponding to approximately Mach 1.6 in air, and then the fluid may be gradually changed from $CO_2$ to air.

For example, without limitation, supersonic compressor rotor 40 may be sized and configured to attain steady-state operation at a value of relative Mach number in air of approximately 1.6. In such configuration, startup with $CO_2$ requires a minimum throat area that is approximately 80% of the area of the inlet, steady-state operation with air requires a minimum throat area that is approximately 80% of the area of the inlet, and startup with air requires a minimum throat area that is approximately 90% of the area of the inlet. Therefore, for supersonic compressor rotor 40 designed to operate with a relative Mach number in air of approximately 1.6, a throat area of approximately 80% of the area of the inlet will suffice to facilitate startup with $CO_2$ and steady-state operation with air. Moreover, a benefit of a throat size reduction of approximately 10% may be facilitated, wherein such 10% is representative of a difference between approximately 90% of the area of the inlet (associated with startup with air) to approximately 80% of the area of the inlet (associated with startup with $CO_2$). This 10% size reduction of the throat area facilitates an increase in efficiency of supersonic compressor rotor 40.

Alternatively, the air-for-$CO_2$ substitution may be started and/or performed at a different supersonic speed than the speed where curves 208 and 346 intersect. Supersonic compressor rotor 40 may be sized and configured for any given relative Mach number for air wherein starting curve 346 for $CO_2$ is below starting curve 206 for air such that a minimum throat area value for startup with $CO_2$ is less than a minimum throat area value for startup with air. Therefore, the throat area of supersonic compressor rotor 40 is determined as the greater of the values of starting curve 346 for $CO_2$ and steady-state operating curve 208 for air at a given speed. As such, the determined throat area is below that associated with starting curve 206 for air for the same relative Mach number for air, thereby facilitating higher efficiency operation than a rotor similar to rotor 40 using substantially identical fluids for both startup and steady-state operation.

For example, without limitation, supersonic compressor rotor 40 may be sized and configured to attain steady-state operation at a value of relative Mach number in air of approximately 1.4. In such configuration, startup with $CO_2$ requires a minimum throat area that is approximately 85% of the area of the inlet, steady-state operation with air requires a minimum throat area that is approximately 90% of the area of the inlet, and startup with air requires a minimum throat area that is approximately 95% of the area of the inlet. Therefore, for supersonic compressor rotor 40 designed to operate with a relative Mach number in air of approximately 1.4, a throat area of approximately 90% of the area of the inlet will suffice to facilitate startup with $CO_2$ and steady-state operation with air. Moreover, a benefit of a throat size reduction of approximately 5% may be facilitated, wherein such 5% is representative of a difference between approximately 95% of the area of the inlet (associated with startup with air) to approximately 90% of the area of the inlet (associated with steady-state with air). This 5% size reduction of the throat area facilitates an increase in efficiency of supersonic compressor rotor 40.

Also, for example, again without limitation, supersonic compressor rotor 40 may be sized and configured to attain steady-state operation at a value of relative Mach number in air of approximately 1.8. In such configuration, startup with $CO_2$ requires a minimum throat area that is approximately 76% of the area of the inlet, steady-state operation with air requires a minimum throat area that is approximately 70% of the area of the inlet, and startup with air requires a minimum throat area that is approximately 85% of the area of the inlet. Therefore, for supersonic compressor rotor 40 designed to operate with a relative Mach number in air of approximately 1.8, a throat area of approximately 76% of the area of the inlet will suffice to facilitate startup with $CO_2$ and steady-state operation with air. Moreover, a benefit of a throat size reduction of approximately 9% may be facilitated, wherein such 9% is representative of a difference between approximately 85% of the area of the inlet (associated with startup with air) to approximately 76% of the area of the inlet (associated with startup with $CO_2$). Such approximately 9% size reduction of the throat area facilitates an increase in efficiency of supersonic compressor rotor 40.

Figure 10:
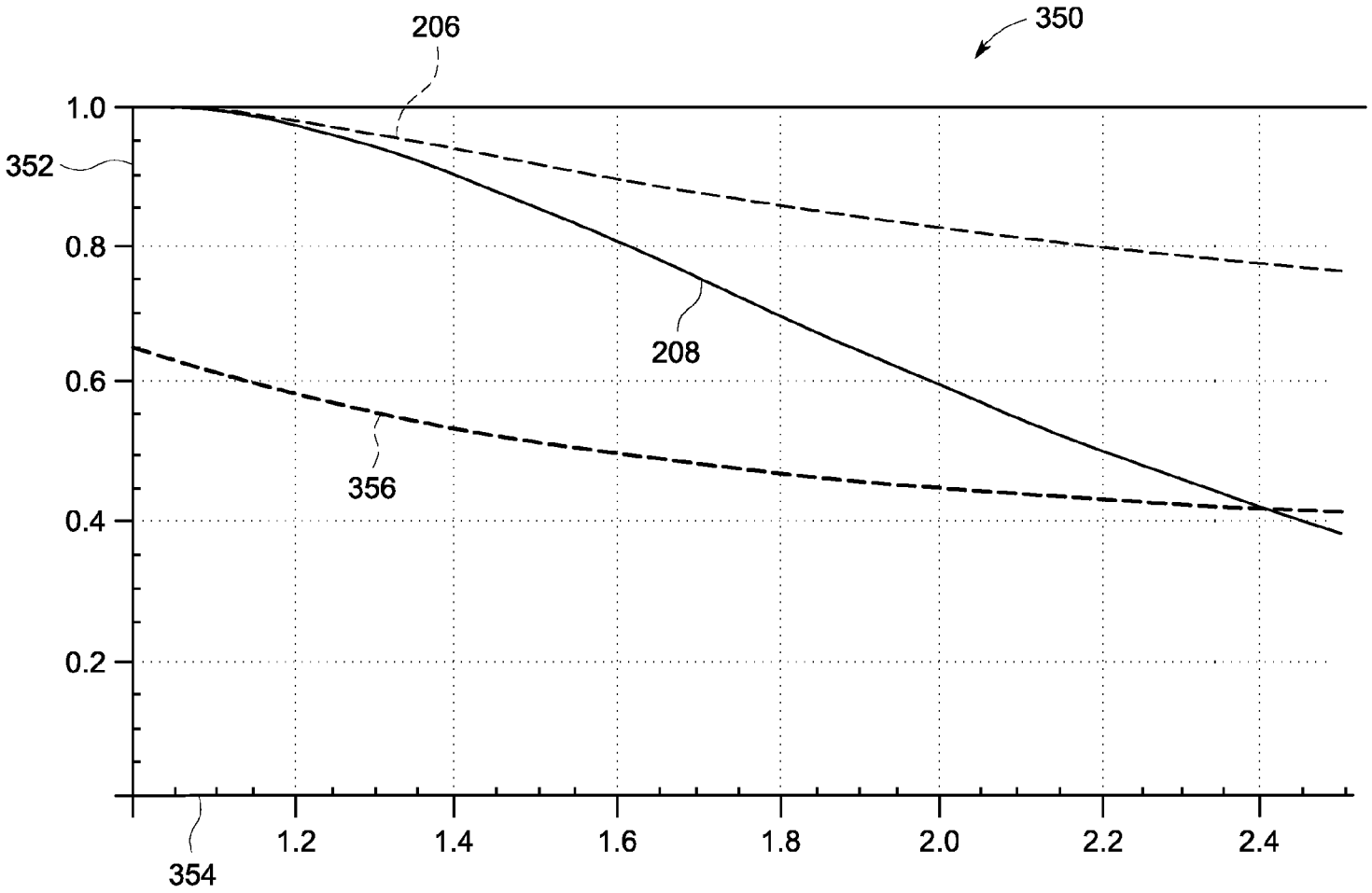
FIG. 10 is a graphical view of a relationship between a throat area and a Mach number for air and sulfur hexafluoride for various conditions for the supersonic compressor rotor shown in FIGS. 4 and 5.

FIG. 10 is a graphical view 350 of a relationship between a throat area and a relative flow speed for air and $SF_6$ for various conditions for supersonic compressor rotor 40 (shown in FIGS. 4 and 5). Graph 350 includes an ordinate, that is, a y-axis 352 that represents numerical values for a ratio of throat area (A*) to an inlet area ($A_{inlet}$) in unitless increments of 0.2 from 0.0 to 1.0. Graph 350 also includes an abscissa, that is, an x-axis 354 that represents numerical values for fluid speed normalized by the speed of sound in air as a relative Mach number in increments of 0.2 from 1.0 to 2.4 such that X-axis 354 represents a relative Mach number for air, but not for $SF_6$. Graph 350 further includes starting curve 206 for air and steady-state operating curve 208 for air, both as described above in FIG. 6.

Graph 350 also includes a starting curve 356 for $SF_6$ that represents a minimum throat area-to-inlet area ratio for starting operation of supersonic compressor rotor 40. For a constant $A_{inlet}$, curve 356 is proportional to the minimum throat area required to facilitate supersonic $SF_6$ flow during starting conditions, and also to facilitate formation/maintenance of the oblique and normal shock waves as the rotor increases its rotational speed and a relative Mach number of $SF_6$ flow (not shown in FIG. 10) increases correspondingly therewith. For purposes of illustration, a minimum value of an A*-to-$A_{inlet}$ ratio for a relative fluid speed corresponding to a Mach number (based on a relative speed of sound in air) of 1.8 during startup with $SF_6$ is approximately 0.48, that is, given a constant $A_{inlet}$, a value for A* is approximately 48% of the value for $A_{inlet}$.

Therefore, startup with $SF_6$ as a starting gas facilitates initiation of supersonic flow within a throat area smaller than what would be required to start with air. Given a constant throat area, once startup is completed, that is, the supersonic compressor rotor is at a maintenance rotational speed, air may be gradually substituted for $SF_6$ until steady-state operation is exclusively being conducted with air. More specifically, as indicated by the intersection of curves 208 and 356 at a Mach number of approximately 2.4 in air, a value for a minimum A*-to-$A_{inlet}$ ratio of approximately 0.42 is the same for startup with $SF_6$ and steady-state operation with air. Therefore supersonic compressor rotor 40 with an A*-to-$A_{inlet}$ ratio of approximately 0.42 can be started with $SF_6$ fluid, then the rotor rotational speed can be increased so that the relative speed of the $SF_6$ fluid at the throat attains a speed corresponding to approximately Mach 2.4 in air, and then the fluid may be gradually changed from $SF_6$ to air.

For example, without limitation, supersonic compressor rotor 40 may be sized and configured to attain steady-state operation at a value of relative Mach number in air of approximately 2.4. In such configuration, startup with $SF_6$ requires a minimum throat area that is approximately 42% of the area of the inlet, steady-state operation with air requires a minimum throat area that is approximately 42% of the area of the inlet, and startup with air requires a minimum throat area that is approximately 78% of the area of the inlet. Therefore, for supersonic compressor rotor 40 designed to operate with a relative Mach number in air of approximately 2.4, a throat area of approximately 42% of the area of the inlet will suffice to facilitate startup with $SF_6$ and steady-state operation with air. Moreover, a benefit of a throat size reduction of approximately 36% may be facilitated, wherein such 36% is representative of a difference between approximately 78% of the area of the inlet (associated with startup with air) to approximately 42% of the area of the inlet (associated with startup with $SF_6$). This 36% size reduction of the throat area facilitates an increase in efficiency of supersonic compressor rotor 40.

Alternatively, the air-for-$SF_6$ substitution may be started and/or performed at a different supersonic speed than the speed where curves 208 and 356 intersect. Supersonic compressor rotor 40 may be sized and configured for any given relative Mach number for air wherein starting curve 356 for $SF_6$ is below starting curve 206 for air such that a minimum throat area value for startup with $SF_6$ is less than a minimum throat area value for startup with air. Therefore, the throat area of supersonic compressor rotor 40 is determined as the greater of the values of starting curve 356 for $SF_6$ and steady-state operating curve 208 for air at a given speed. As such, the determined throat area is below that associated with starting curve 206 for air for the same relative Mach number for air, thereby facilitating higher efficiency operation than a rotor similar to rotor 40 using substantially identical fluids for both startup and steady-state operation.

For example, without limitation, supersonic compressor rotor 40 may be sized and configured to attain steady-state operation at a value of relative Mach number in air of approximately 2.0. In such configuration, startup with $SF_6$ requires a minimum throat area that is approximately 45% of the area of the inlet, steady-state operation with air requires a minimum throat area that is approximately 60% of the area of the inlet, and startup with air requires a minimum throat area that is approximately 83% of the area of the inlet. Therefore, for supersonic compressor rotor 40 designed to operate with a relative Mach number in air of approximately 2.0, a throat area of approximately 60% of the area of the inlet will suffice to facilitate startup with $SF_6$ and steady-state operation with air. Moreover, a benefit of a throat size reduction of approximately 23% may be facilitated, wherein such 23% is representative of a difference between approximately 83% of the area of the inlet (associated with startup with air) to approximately 60% of the area of the inlet (associated with steady-state with air). This 23% size reduction of the throat area facilitates an increase in efficiency of supersonic compressor rotor 40.

Also, for example, again without limitation, supersonic compressor rotor 40 may be sized and configured to attain steady-state operation at a value of relative Mach number in air of approximately 2.5. In such configuration, startup with $SF_6$ requires a minimum throat area that is approximately 41% of the area of the inlet, steady-state operation with air requires a minimum throat area that is approximately 38% of the area of the inlet, and startup with air requires a minimum throat area that is approximately 77% of the area of the inlet. Therefore, for supersonic compressor rotor 40 designed to operate with a relative Mach number in air of approximately 2.5, a throat area of approximately 42% of the area of the inlet will suffice to facilitate startup with $SF_6$ and steady-state operation with air. Moreover, a benefit of a throat size reduction of approximately 35% may be facilitated, wherein such 35% is representative of a difference between approximately 77% of the area of the inlet (associated with startup with air) to approximately 42% of the area of the inlet (associated with startup with $SF_6$). Such approximately 35% size reduction of the throat area facilitates an increase in efficiency of supersonic compressor rotor 40.

Figure 11:
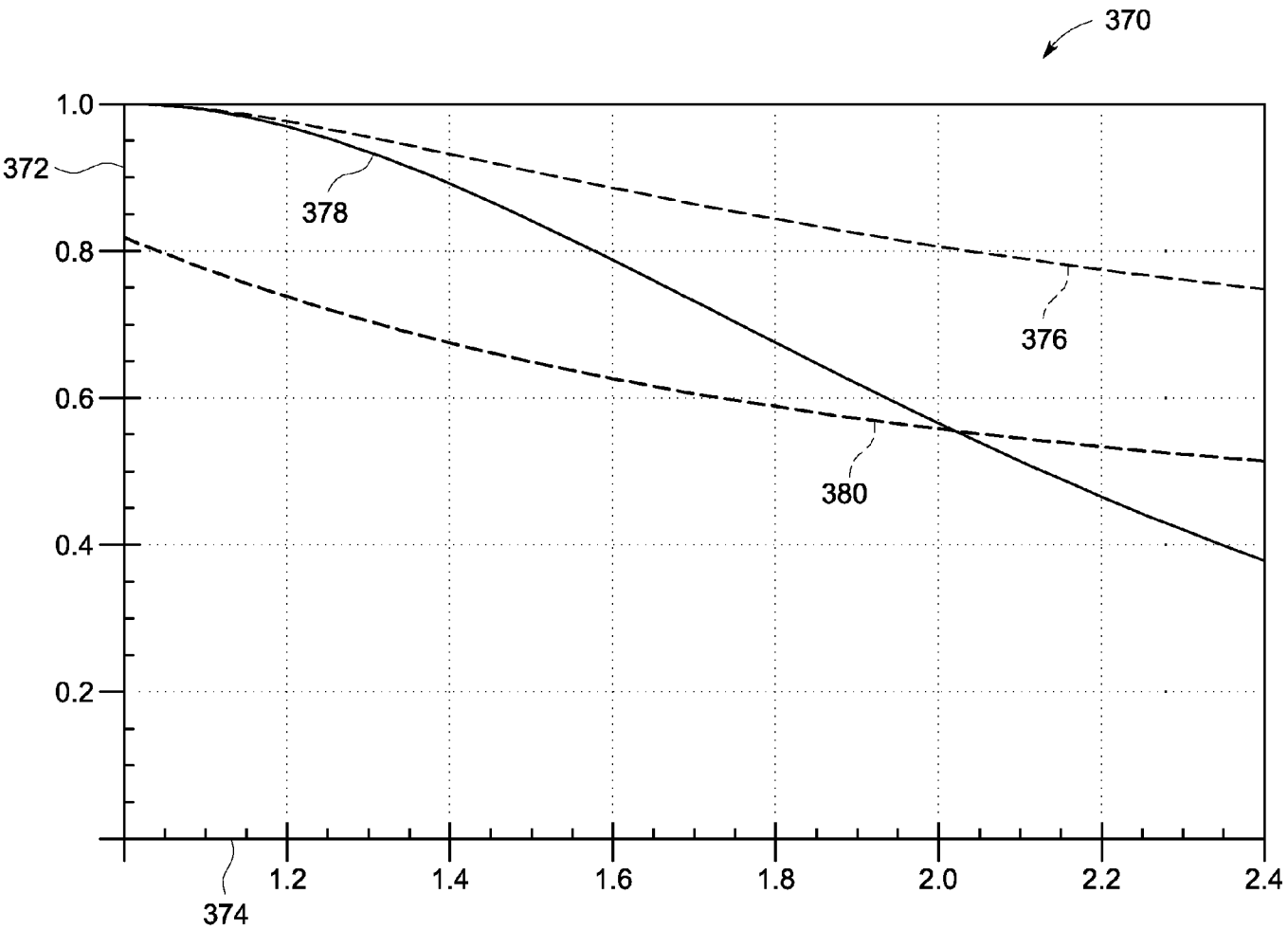
FIG. 11 is a graphical view of a relationship between a throat area and a Mach number for methane ($CH_4$) and propane ($C_3H_8$) for various conditions for the supersonic compressor rotor shown in FIGS. 4 and 5.

FIG. 11 is a graphical view of a relationship between a throat area and a relative flow speed for methane ($CH_4$) and propane ($C_3H_8$) for various conditions for the supersonic compressor rotor shown in FIGS. 4 and 5. Graph 370 is plotted with an adoption of a perfect inviscid gas assumption to illustrate the mechanisms described herein, wherein it is understood that plots for real gases may differ to some extent, however, substantially similar behaviors are expected to be observed with substantially similar benefits attained. Graph 370 includes an ordinate, that is, a y-axis 372 that represents numerical values for a ratio of throat area (A*) to an inlet area ($A_{inlet}$) in unitless increments of 0.2 from 0.0 to 1.0. Graph 370 also includes an abscissa, that is, an x-axis 374 that represents numerical values for fluid speed normalized by speed of sound in $CH_4$ in increments of 0.2 from 1.0 to 2.4 such that X-axis 374 represents a relative Mach number for $CH_4$, but not for $C_3H_8$.

Graph 370 also includes a starting curve 376 for $CH_4$ that represents a minimum throat area-to-inlet area ratio for starting operation of supersonic compressor rotor 40. For a constant $A_{inlet}$, curve 376 is proportional to the minimum throat area required to facilitate supersonic $CH_4$ flow during starting conditions, and to facilitate formation/maintenance of the oblique and normal shock waves as the rotor increases its rotational speed and a relative Mach number of $CH_4$ flow (not shown in FIG. 11) increases correspondingly therewith. For purposes of illustration, a minimum value of an A*-to-$A_{inlet}$ ratio for a relative fluid speed corresponding to a Mach number of 1.8 (based on a relative speed of sound in $CH_4$) during startup with $CH_4$ is approximately 0.85, that is, given a constant $A_{inlet}$, a value for A* is approximately 85% of the value for $A_{inlet}$.

Starting curve 376 is contrasted to a steady-state operating curve 378 for $CH_4$ that represents an A*-to-$A_{inlet}$ ratio for steady-state operation of supersonic compressor rotor 40. This means that for a constant $A_{inlet}$, curve 378 is proportional to the minimum throat area required to facilitate supersonic $CH_4$ flow during steady-state conditions with maintenance of the oblique and normal shock waves as the rotor maintains its rotational speed and a relative Mach number of $CH_4$ flow is maintained correspondingly therewith. For example, a minimum value of an A*-to-$A_{inlet}$ ratio for a relative fluid speed corresponding to a Mach number of 1.8 (based on a relative speed of sound in $CH_4$) during steady-state operation is approximately 0.68, that is, given a constant $A_{inlet}$, a value for A* is approximately 68% of the value for $A_{inlet}$.

Graph 370 further includes a starting curve 380 for $C_3H_8$ that represents a minimum throat area-to-inlet area ratio for starting operation of supersonic compressor rotor 40. For a constant $A_{inlet}$, curve 380 is proportional to the minimum throat area required to facilitate supersonic $C_3H_8$ flow during starting conditions, and also to facilitate formation/maintenance of the oblique and normal shock waves as the rotor increases its rotational speed and a relative Mach number of $C_3H_8$ flow (not shown in FIG. 11) increases correspondingly therewith. For illustrative purposes, a minimum value of an A*-to-$A_{inlet}$ ratio for a relative fluid speed corresponding to a Mach number of 1.8 (based on a relative speed of sound in $CH_4$) during startup with $C_3H_8$ is approximately 0.59, that is, given a constant $A_{inlet}$, a value for A* is approximately 59% of the value for $A_{inlet}$.

Therefore, startup with $C_3H_8$ as a starting gas facilitates initiation of supersonic flow within a throat area smaller than what would be required to start with $CH_4$. Given a constant throat area, once startup is completed, that is, the supersonic compressor rotor is at a maintenance rotational speed, $CH_4$ may be gradually substituted for $C_3H_8$ until steady-state operation is exclusively being conducted with $CH_4$. More specifically, as indicated by the intersection of curves 378 and 380, when the fluid at the throat attains a supersonic speed corresponding to a Mach number of approximately 2.0 in $CH_4$, a value for a minimum A*-to-$A_{inlet}$ ratio of approximately 0.57 is the same for startup with $C_3H_8$ and steady-state operation with $CH_4$. Therefore supersonic compressor rotor 40 with an A*-to-$A_{inlet}$ ratio of approximately 0.57 can be started with $C_3H_8$ fluid, then the rotor rotational speed can be increased so that the relative speed of the $C_3H_8$ fluid at the throat attains a speed corresponding to approximately Mach 2.0 in $CH_4$, and then the fluid may be gradually changed from $C_3H_8$ to $CH_4$.

For example, without limitation, supersonic compressor rotor 40 may be sized and configured to attain steady-state operation at a value of relative Mach number in air of approximately 2.0. In such configuration, startup with $C_3H_8$ requires a minimum throat area that is approximately 57% of the area of the inlet, steady-state operation with $CH_4$ requires a minimum throat area that is approximately 57% of the area of the inlet, and startup with $CH_4$ requires a minimum throat area that is approximately 81% of the area of the inlet. Therefore, for supersonic compressor rotor 40 designed to operate with a relative Mach number in $CH_4$ of approximately 2.0, a throat area of approximately 57% of the area of the inlet will suffice to facilitate startup with $C_3H_8$ and steady-state operation with $CH_4$. Moreover, a benefit of a throat size reduction of approximately 24% may be facilitated, wherein such 24% is representative of a difference between approximately 81% of the area of the inlet (associated with startup with $CH_4$) to approximately 57% of the area of the inlet (associated with startup with $C_3H_8$). This 24% size reduction of the throat area facilitates an increase in efficiency of supersonic compressor rotor 40.

Alternatively, the $CH_4$-for-$C_3H_8$ substitution may be started and/or performed at a different supersonic speed than the speed where curves 378 and 380 intersect. Supersonic compressor rotor 40 may be sized and configured for any given relative Mach number for air wherein starting curve 380 for $C_3H_8$ is below starting curve 376 for $CH_4$ such that a minimum throat area value for startup with $C_3H_8$ is less than a minimum throat area value for startup with $CH_4$. Therefore, the throat area of supersonic compressor rotor 40 is determined as the greater of the values of starting curve 380 for $C_3H_8$ and steady-state operating curve 378 for $CH_4$ at a given speed. As such, the determined throat area is below that associated with starting curve 376 for $CH_4$ for the same relative Mach number for $CH_4$, thereby facilitating higher efficiency operation than a rotor similar to rotor 40 using substantially identical fluids for both startup and steady-state operation.

For example, without limitation, supersonic compressor rotor 40 may be sized and configured to attain steady-state operation at a value of relative Mach number in $CH_4$ of approximately 1.8. In such configuration, startup with $C_3H_8$ requires a minimum throat area that is approximately 58% of the area of the inlet, steady-state operation with $CH_4$ requires a minimum throat area that is approximately 68% of the area of the inlet, and startup with $CH_4$ requires a minimum throat area that is approximately 86% of the area of the inlet. Therefore, for supersonic compressor rotor 40 designed to operate with a relative Mach number in $CH_4$ of approximately 1.8, a throat area of approximately 68% of the area of the inlet will suffice to facilitate startup with $C_3H_8$ and steady-state operation with $CH_4$. Moreover, a benefit of a throat size reduction of approximately 18% may be facilitated, wherein such 18% is representative of a difference between approximately 86% of the area of the inlet (associated with startup with $CH_4$) to approximately 68% of the area of the inlet (associated with steady-state with $CH_4$). This 18% size reduction of the throat area facilitates an increase in efficiency of supersonic compressor rotor 40.

Also, for example, again without limitation, supersonic compressor rotor 40 may be sized and configured to attain steady-state operation at a value of relative Mach number in $CH_4$ of approximately 2.2. In such configuration, startup with $C_3H_8$ requires a minimum throat area that is approximately 53% of the area of the inlet, steady-state operation with $CH_4$ requires a minimum throat area that is approximately 47% of the area of the inlet, and startup with $CH_4$ requires a minimum throat area that is approximately 78% of the area of the inlet. Therefore, for supersonic compressor rotor 40 designed to operate with a relative Mach number in air of approximately 2.2, a throat area of approximately 53% of the area of the inlet will suffice to facilitate startup with $C_3H_8$ and steady-state operation with $CH_4$. Moreover, a benefit of a throat size reduction of approximately 25% may be facilitated, wherein such 25% is representative of a difference between approximately 78% of the area of the inlet (associated with startup with $CH_4$) to approximately 53% of the area of the inlet (associated with startup with $C_3H_8$). Such approximately 25% size reduction of the throat area facilitates an increase in efficiency of supersonic compressor rotor 40.

Referring to FIG. 7, in operation, startup fluid source 304 is coupled to inlet opening 76 via fluid control device 308 and control system 310. Specifically, control system 310 modulates components within device 308 including, without limitation, valving, pumps, motors, and electric, pneumatic, and/or hydraulic power supplies based on a plurality of variables that include, without limitation, rotor speed, mass fluid flow rates, fluid discharge pressures, fluid relative velocities, compression ratios, fluid temperatures, and temporal parameters.

Initially, supersonic compressor rotor 40 is substantially stationary and a first, i.e., startup fluid is channeling from startup fluid source 304 to fluid flow channel inlet 76 during a first operational mode of supersonic compressor system 10, wherein the first operational mode of supersonic compressor system 10 is a starting, or startup mode. In the exemplary embodiment, the startup fluid has a first plurality of fluid properties that permit attainment of a supersonic flow in throat portion 124 of fluid flow channel 80 during the startup mode. Also, in the exemplary embodiment, the startup fluid includes, without limitation, at least one of $CO_2$, $SF_6$, air, $C_3H_8$, and $C_4H_{10}$, wherein, the startup fluid properties include a first speed of sound value.

Also, in operation, supersonic compressor rotor 40, and the startup fluid channeled therethrough, are accelerated from initially subsonic flow to supersonic flow of the startup fluid in throat portion 124 of the fluid flow channel 80 during the startup operational mode.

Further, in operation, upon attainment of a predetermined speed of the startup fluid as described above, fluid control device 308 and control system 310 transition from channeling the startup fluid during the startup mode of operation to channeling a second, i.e., a steady-state fluid during a second mode of operation of supersonic compressor system 10, wherein the second operational mode is a steady-state mode. Therefore, channeling a steady-state fluid from steady-state fluid source 306 to fluid flow channel inlet 76 at a relative supersonic speed during the steady-state operational mode facilitates maintenance of supersonic flow of the steady-state fluid in throat portion 124 of fluid flow channel 80. In the exemplary embodiment, the steady-state fluid includes, without limitation, at least one of air, $CO_2$, $N_2$, $CH_4$, and natural gas with a predetermined weight percent of methane. The steady-state fluid has a second speed of sound value that is greater than the first speed of sound value for the startup fluid. Supersonic compressor rotor 40 may, or may not, be further accelerated or decelerated during and after the transition from the startup fluid to the steady-state fluid.

In one embodiment, the startup fluid and the steady-state fluid are different singular gases, for example, without limitation, $CO_2$ is the startup fluid and air is the steady-state fluid, wherein the transition from $CO_2$ to air is performed at a relative fluid speed of approximately 1.6 times the speed of sound in air (as shown in FIG. 9). Alternatively, the startup fluid and the steady-state fluid are different gaseous mixtures, for example, without limitation, the startup fluid is a predetermined mixture of gases that include those listed above for the startup fluids, and the steady-state fluid is a predetermined mixture of gases that include those listed above for the steady-state fluids.

Further, alternatively, the startup fluid and the steady-state fluid are substantially similar singular gases and/or substantially similar gaseous mixtures. More specifically, the startup fluid and the steady-state fluid are one of substantially similar singular gases and/or substantially similar gaseous mixtures, wherein the startup fluid has a first temperature and the steady-state fluid has a second temperature that is different from the first temperature. The speed of sound in a fluid is a function of the temperature of the fluid such that the speed of sound in the fluid increases with increasing temperatures. Moreover, as described above, fluids with lower speeds of sound are better startup fluids than fluids with higher speeds of sound. Therefore, for example, without limitation, the startup fluid may be air at a first temperature and the steady-state fluid may be air at a second temperature, wherein the second temperature is greater than the first temperature.

Moreover, alternatively, the startup fluid and the steady-state fluid are one of different singular gases, different gaseous mixtures, substantially similar singular gases, and substantially similar gaseous mixtures as described above, however, in addition, such fluids include at least one of entrained liquid particles and/or entrained solid particles.

The above-described supersonic compressor startup support system provides a cost effective and reliable method for increasing an efficiency in performance of supersonic compressor systems during starting operations. Moreover, the supersonic compressor startup support system facilitates increasing the operating efficiency of the supersonic compressor system by facilitating use of a constant geometry throat region to form and maintain a normal shock wave downstream of the throat region. More specifically, the supersonic compressor startup support system includes at least one fluid source that channels at least one fluid with the fluid properties that facilitates formation and maintenance of normal shock waves in a proper position during both startup and steady-state operations.

Exemplary embodiments of systems and methods for starting a supersonic compressor rotor are described above in detail. The system and methods are not limited to the specific embodiments described herein, but rather, components of systems and/or steps of the method may be utilized independently and separately from other components and/or steps described herein. For example, the systems and methods may also be used in combination with other rotary engine systems and methods, and are not limited to practice with only the supersonic compressor system as described herein. Rather, the exemplary embodiment can be implemented and utilized in connection with many other rotary system applications.

Although specific features of various embodiments of the invention may be shown in some drawings and not in others, this is for convenience only. Moreover, references to "one embodiment" in the above description are not intended to be interpreted as excluding the existence of additional embodiments that also incorporate the recited features. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A method for starting a supersonic compressor, said method comprising:

providing a supersonic compressor comprising:

a fluid inlet coupled in fluid communication with a first fluid source and a second fluid source;

a fluid outlet;

a fluid conduit extending between the fluid inlet and the fluid outlet; and at least one supersonic compressor rotor disposed within the fluid conduit of the supersonic compressor and comprising a fluid flow channel comprising a throat portion and a fluid flow channel inlet;

channeling a first fluid from the first fluid source to the fluid flow channel inlet during a first operational mode of the supersonic compressor, the first fluid having a first plurality of fluid properties that permit attainment of a supersonic flow in the throat portion of the fluid flow channel during the first operational mode of the supersonic compressor;

accelerating the first fluid from initially subsonic flow to supersonic flow in the throat portion of the fluid flow channel during the first operational mode of the supersonic compressor; and channeling a second fluid from the second fluid source to the fluid flow channel inlet at a supersonic fluid velocity during a second operational mode of the supersonic compressor, the second fluid having a second plurality of fluid properties that permit maintenance of supersonic flow of the second fluid in the throat portion of the fluid flow channel during the second operational mode of the supersonic compressor, wherein the first fluid and the second fluid are different singular gases and the first fluid comprises at least one of carbon dioxide ($CO_2$), sulfur hexafluoride ($SF_6$), air, propane ($C_3H_8$), and butane ($C_4H_{10}$), the first fluid has a first speed of sound value; and the second fluid comprises at least one of nitrogen ($N_2$), methane ($CH_4$), and natural gas with a predetermined weight percent of methane, the second fluid has a second speed of sound value, the second speed of sound value greater than the first speed of sound value.

2. The method according to claim 1, wherein the first fluid has a first temperature and the second fluid has a second temperature that is different from the first temperature.

3. The method according to claim 1, wherein the first fluid source and the second fluid source are connected to the fluid flow channel inlet by a fluid control device.

4. The method according to claim 3, wherein the fluid control device of the supersonic compressor transitions from channeling the first fluid during the first mode of operation of the supersonic compressor to channeling the second fluid during the second mode of operation of the supersonic compressor, wherein the first operational mode of the supersonic compressor is a starting mode and the second operational mode of the supersonic compressor is a steady-state mode.

5. The method according to claim 4, wherein the first mode of operation is a startup mode and the second mode of operation is a steady-state mode, and the method further comprises:

modulating the first fluid in a decreasing manner; and modulating the second fluid in an increasing manner.

6. The method of claim 5, further comprising:

stopping the first fluid channeling and channeling the second fluid in the steady-state mode.

* * * * *